United States Patent [19]

Barnett

[11] 4,318,642

[45] Mar. 9, 1982

[54] WALLS

[75] Inventor: Clifford R. Barnett, Auckland, New Zealand

[73] Assignee: Bells & Mills Limited, Auckland, New Zealand

[21] Appl. No.: 168,725

[22] Filed: Jul. 14, 1980

Related U.S. Application Data

[63] Continuation of Ser. No. 939,200, Sep. 5, 1978, abandoned.

[30] Foreign Application Priority Data

Sep. 5, 1977 [NZ] New Zealand ..... 185102

[51] Int. Cl.[3] ..... E02B 3/12

[52] U.S. Cl. ..... 405/284; 405/15

[58] Field of Search ..... 405/15-35, 405/284-287

[56] References Cited

U.S. PATENT DOCUMENTS

| | | | |
|---|---|---|---|
| 2,413,867 | 1/1947 | Easterday | 405/286 |
| 2,653,450 | 9/1953 | Fort | 405/287 |
| 2,892,340 | 6/1959 | Fort | 405/286 X |
| 3,176,468 | 4/1965 | Nagai et al. | 405/29 |
| 4,080,793 | 3/1978 | Pulsifer | 405/30 |
| 4,083,190 | 4/1978 | Pey | 405/33 |
| 4,188,153 | 2/1980 | Taylor | 405/30 |

FOREIGN PATENT DOCUMENTS

| | | | |
|---|---|---|---|
| 2324214 | 11/1974 | Fed. Rep. of Germany | 405/30 |
| 2303119 | 10/1976 | France | 405/30 |

*Primary Examiner*—Dennis L. Taylor

*Attorney, Agent, or Firm*—Holman & Stern

[57] ABSTRACT

A method of making walls which comprises assembling a series of rings in the form of short tubes one above the other. The rings are interlinked one with the other so that a wall is constructed which is capable of resisting overturning forces applied normally to the height of the wall. The rings are arranged so that adjacent rings in a row are closely adjacent to or touch each other and rings in adjacent rows are stretcher bonded so that the contact points between rings in one row and rings in the next row are on any selected ring on radial lines separated by an approximately 60° arc of the face of that ring exposed to view when looking at a retaining wall and the unexposed face of the ring is pressed against soil retained by the retain wall. The cavities within and between the rings may be filled with suitable material such as crushed rock.

13 Claims, 49 Drawing Figures

1
2
2
3
4
5
6.7
10
11
12
13
14
8
9
5
10
15
16
17
18
19
20
21

SECTION Y-Y

SECTION X-X

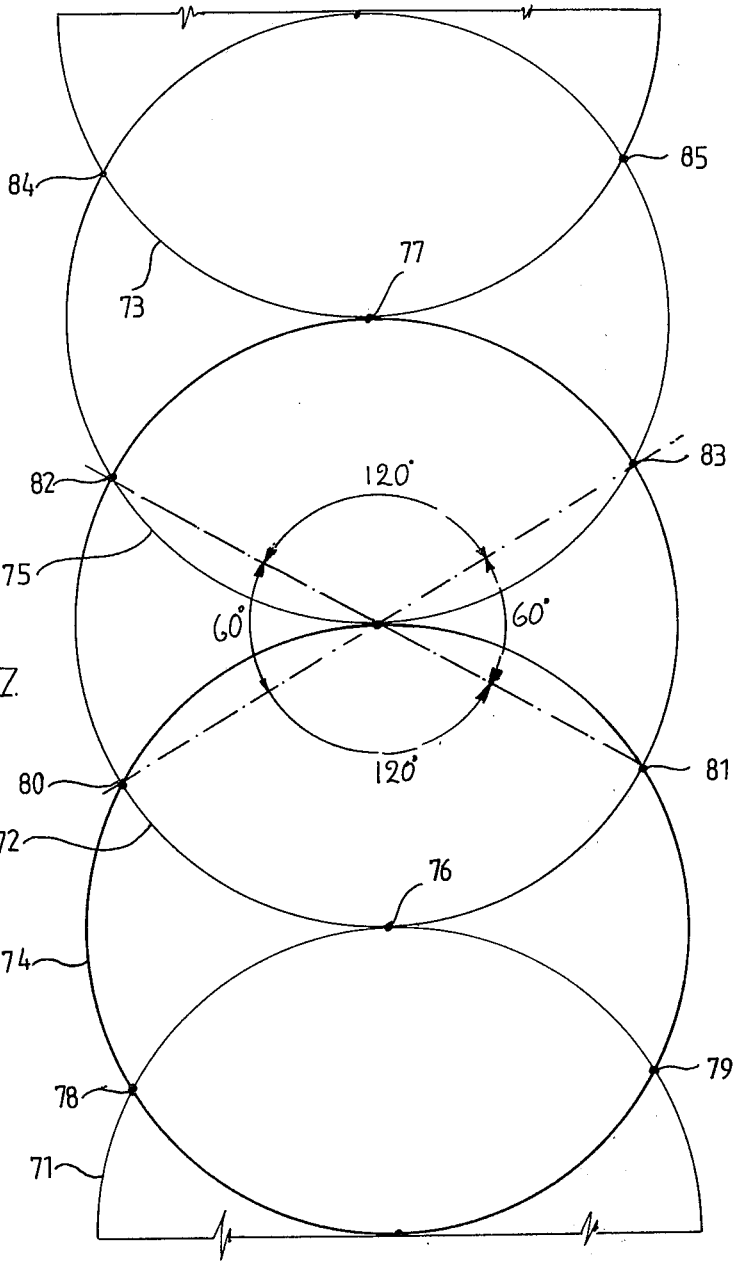
FIG 47.
FIG 48
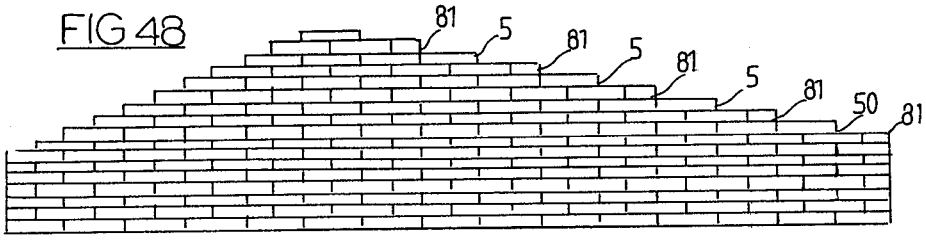

WALLS

This is a continuation of application Ser. No. 939,200, filed Sept. 5, 1978, abandoned.

BRIEF SUMMARY OF THE INVENTION

This invention relates to walls.

It is an object of the present invention to provide an element for making walls and/or walls using such elements which will at least provide the public with a useful choice.

Accordingly in one aspect the invention consists in a method of making walls, said method comprising the steps of assembling a series of rings in the form of short tubes one above the other the rings being interlinked one with the other so that a wall is constructed capable of resisting overturning forces applied normally to the height of the wall, the rings being arranged so that adjacent rings in a row are closely adjacent to or touch each other and rings in adjacent rows are stretcher bonded so that the contact points between rings in one row and rings in the next row are on any selected ring, on radial lines separated by an approximately 60° arc of the face of that ring exposed to view when looking at a retaining wall and of the face of the ring which is pressed against the soil retained by the retaining wall.

In a further aspect the invention consists in a wall element comprising a ring in the form of a short tube constructed and arranged so that a series of such rings can be erected side by side and one above the other to provide a wall capable of resisting overturning forces applied normally to the height of the wall, the rings being arranged in association with other such rings in use so that adjacent rings in a row are closely adjacent to or touch each other and rings in adjacent rows are stretcher bonded so that the contact points between rings in one row and rings in the next row are on any selected ring, on radial lines spearated by an approximately 60° arc of the face of that ring exposed to view when looking at a retaining wall and of the face of the ring which is pressed against the soil retained by the retaining wall.

In a still further aspect the invention consists in a wall comprising a plurality of rings in the form of short tubes arranged side by side in rows and with successive rows one above the other bonded to each other to resist forces applied normally to the height of the wall, the rings being arranged so that adjacent rings in a row are closely adjacent to or touch each other and rings in adjacent rows are stretcher bonded so that the contact points between rings in one row and rings in the next row are on any selected ring, on radial lines separated by an approxmately 60° arc of the face of that ring exposed to view when looking at a retaining wall and the face of the ring which is pressed against the soil retained by the retaining wall.

To those skilled in the art to which this invention relates, many changes in construction and widely differing embodiments and applications of the invention will suggest themselves without departing from the scope of the invention as defined in the appended claims. The disclosures and the description herein are purely illustrative and are not intended to be in any sense limiting.

BRIEF DESCRIPTION OF THE SEVERAL VIEWS OF THE DRAWINGS

One preferred form of the invention will now be described with reference to the accompanying drawings in which, FIG. 47 is a diagram showing the metal rings or the rings of FIGS. 15 and 16 fitted in position and showing contact points, FIG. 48 is a general view of a wall containing the plain type rings such as FIG. 17.

DETAILED DESCRIPTION

Figures 1, 2, 3, 4, 5, 6, 7, 8, 9, 10, 11, 12, 13, 14:
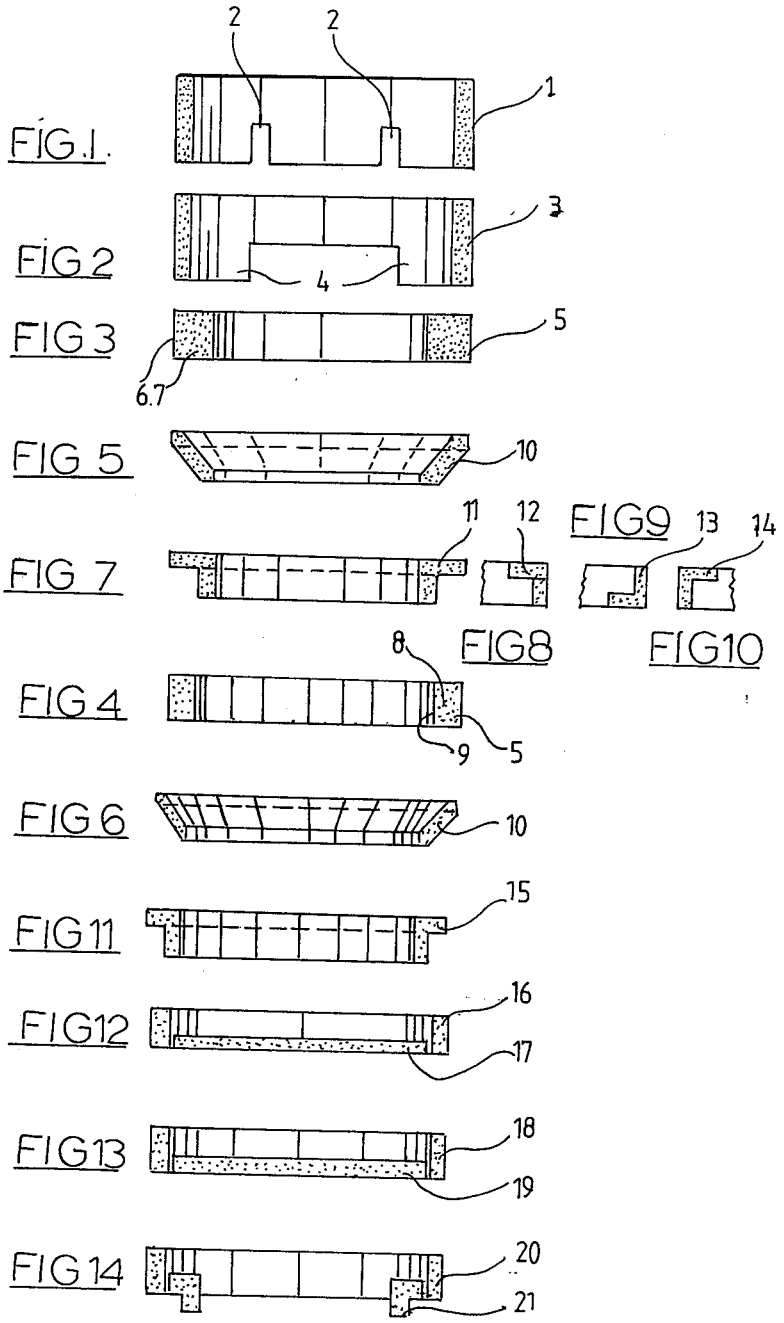
FIGS. 1 to 14 show cross sections of forms of ring or short tube according to the invention.

Referring to the drawings, a series of rings or short tubes are provided which in use are arranged one above the other, the rings and tubes being formed in positions to contain filling having a specified angle of repose without the provision of further soil retaining means as follows:

The rings or tubes may be made of a suitable material, for example, a precast concrete or metal and the construction shown in particular in FIGS. 1 to 14 show cross sections of rings or short tubes made from precast concrete. Thus in FIG. 1 a short tube or ring 1 is provided with notches 2 in which other rings may be fitted as will be described further shortly.

In FIG. 2 a ring 3 has castellations 4 for the same purpose in connection with FIG. 1 while FIG. 3 shows a plain ring 5.

In FIG. 3 a plain ring has approximately square dimensions 6 and 7 while in FIG. 4 the ring 5 has a narrow dimension 8 compared with the longer dimension 9.

In FIG. 5 a ring in the form of a frustum of a cone is provided, the ring being referenced 10.

In FIG. 6 the ring is shown at an angle to the horizontal and again this will be referred to later.

In FIGS. 7 to 11 the ring is in the form of an annular wall 11 of inverted L shape in FIG. 7, an annular wall 12 of inverted L shape having a different cross section from that of the wall 11, while in FIG. 9 the ring is formed from an L shaped annulus 13. In FIG. 10 a further different L shaped annular wall 14 is provided and in FIG. 11 a still further differently dimensioned annular inverted L shaped wall 15 is provided.

In FIG. 12 the cross section shows an annular ring 16 and a disc shaped floor 17, the construction being similarly shown in FIG. 13 where there is an annular wall 18 and a bottom 19.

In FIG. 14 an annular short tube 20 is associated with an inverted L shaped bottom 21. These constructions will be referred to in more detail later.

Figure 15:
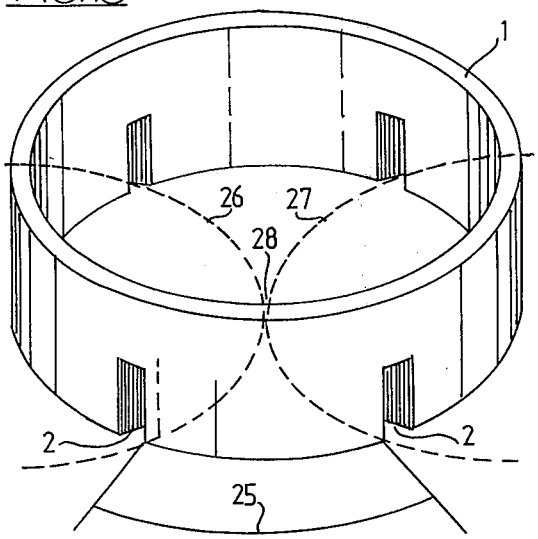
FIGS. 15 to 17 are isometric sketches of the types of ring shown in FIGS. 1 to 4 respectively.
Figure 16:
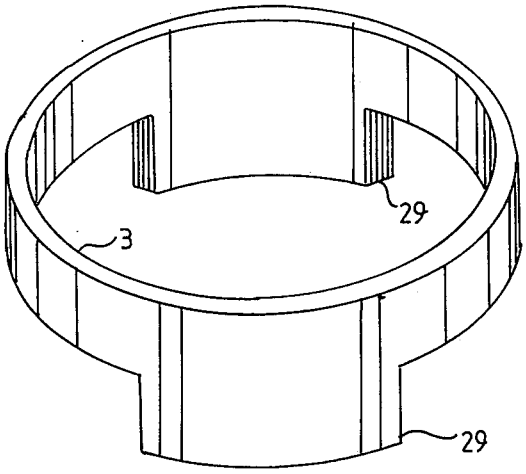

Referring now to FIG. 15 it will be seen that the construction of FIG. 1 is arranged so that the slots 2 are at an angle 25 of 60°, this gives the result that similar interlinking rings 26 and 27 touch or come close to touching at 28 thus assisting in retaining soil. In a similar manner the construction of FIG. 2 as shown in perspective in FIG. 16 has the projections 29 provided to span an arc of 60°.

Figure 18:
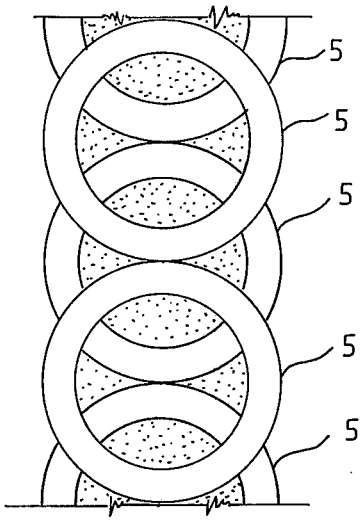
FIG. 18 is a plan view of rings according to FIGS. 3,4 and 17 when installed.
Figure 19:
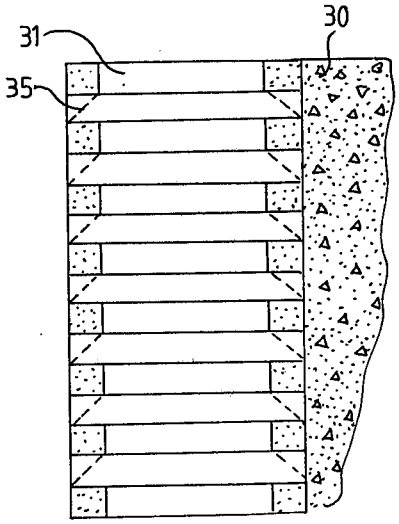
FIG. 19 is a vertical cross section of FIG. 18.
Figure 17:
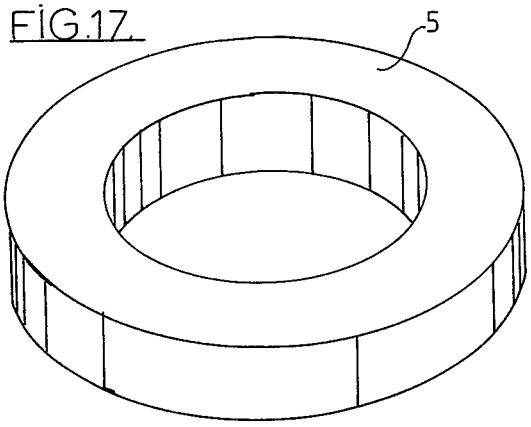

In FIG. 17 the plain ring of FIG. 3 is shown and in FIG. 18 a group of such rings are shown placed one above the other in stretcher bonds and in FIG. 19 such an arrangement is shown supporting back fill 30. The rings may be filled with soil, crushed rock or concrete as shown at 31.

Figure 20:
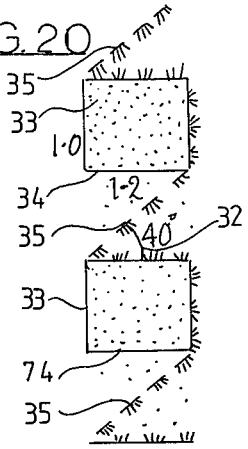
FIG. 20 is an enlargement of parts of two rings shown in FIG. 19 showing the dimensions of the ring and the angle of repose of soil retained by the rings.
Figure 21:
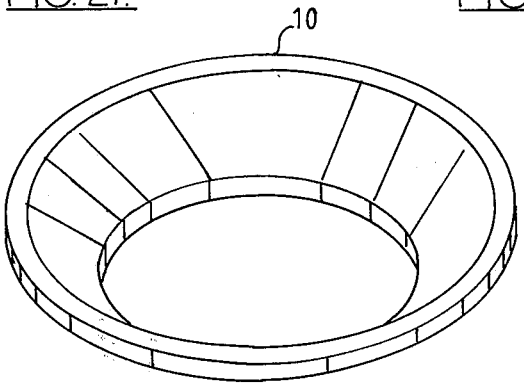
FIG. 21 is an isometric view of the rings shown in cross section in FIGS. 5 and 6, FIGS. 22 to 24 are as FIGS. 18 to 20 but for the construction shown in FIG. 21.
Figure 22:
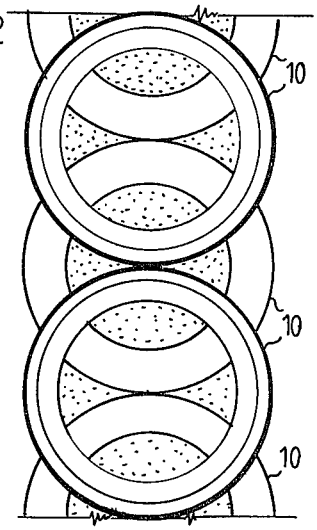

Referring now to FIG. 20 if the angle of repose 32 is 40° as shown in FIG. 20 then the preferred dimension of the annulus 5 is that if dimension 33 is one unit then dimension 34 is 1.2 units. This then enables the filling to lie as shown by the line 35 and to be retained without the addition of further soil retaining means other than the blocks themselves.

Figure 25:
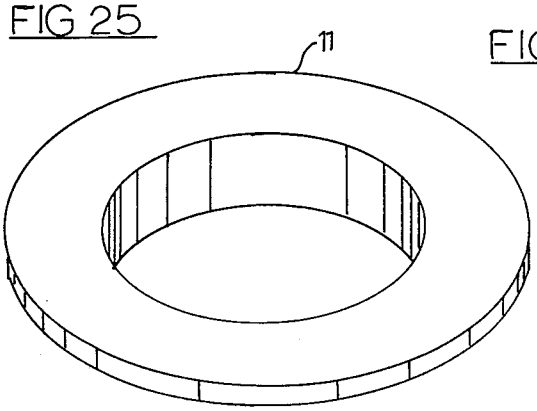
FIG. 25 is an isometric sketch of the type of ring shown in FIGS. 7 to 10.
Figure 26:
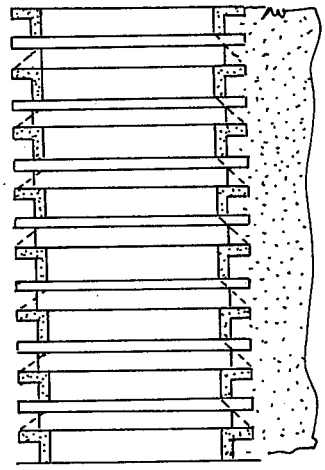
FIG. 26 is a cross section of the rings of FIG. 25 as a retaining wall.
Figure 27:
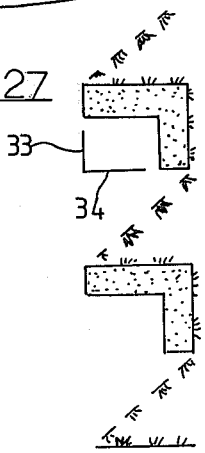
FIG. 27 shows an enlargement of two rings as used in FIG. 26, FIGS. 28 and 29 show inclined views of rings such as the ring shown in FIG. 3 or FIG. 4 showing the effect of the back slope provided.

In FIGS. 21 to 24 the construction of FIGS. 5 and 6 are shown in which the same sort of result as is obtained with the plain ring is obtained because the 40° angle 32 now is such that the line 35 still meets the corners 36 and 37. Similarly FIGS. 25 to 27 show the same arrangement using the ring of FIG. 7 and the same dimensional relationship of 1 of dimension 33 and 1.2 of dimension 34 is provided as is to be seen in FIG. 27.

Figure 28:
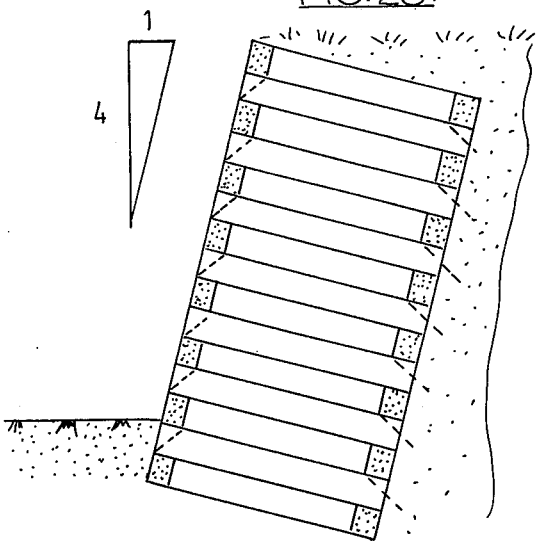
Figure 29:
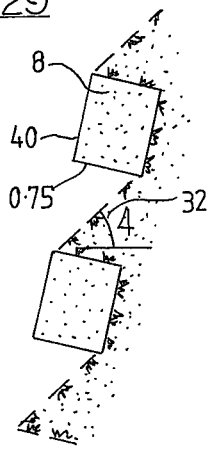

In FIGS. 28 and 29 a plain ring as, for example, the plain ring 4 is tilted at an angle, for example, an angle of 1:4 as shown in FIG. 28 and in this case the ring 8 may have dimensions of 40 as one unit and 41 as 0.75 units to maintain the same angle 32 of 40° from the horizontal, the reduction of the dimension of 1.2 to 0.75 being equal resulting from the angle of tilt of 1:4. Other angles of tilt may of course be used.

Figure 31:
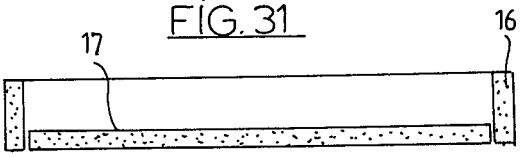
FIGS. 30 and 31 show a plain type of ring having a disc formed bottom plate.
Figure 30:
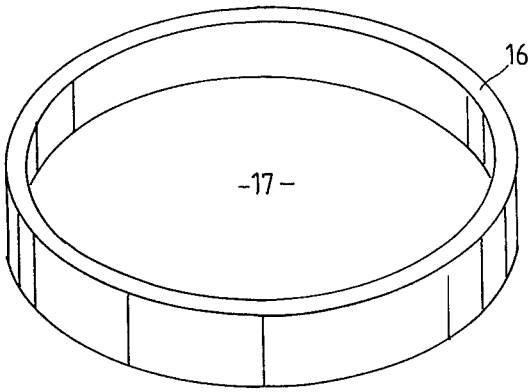

In FIGS. 30 and 31 the construction of FIG. 12 is shown in perspective and in FIG. 31 there is a cross section of this construction showing that the disc floor 17 extends across the width of the ring.

Figure 32:
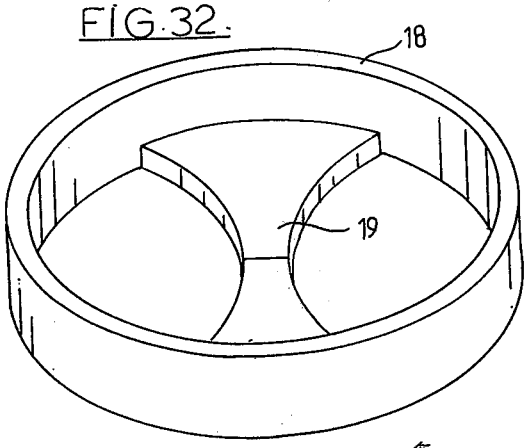
FIG. 32 shows a plain ring having cusp formed bottom plates.

In FIG. 32 the construction of FIG. 13 is shown and it is to be seen that the floor in this case is of cusp form so that as the rings are positioned in stretcher bond retention of soil by the wall formed by the rings results in that retention without the provision of further retaining means.

Figure 33:
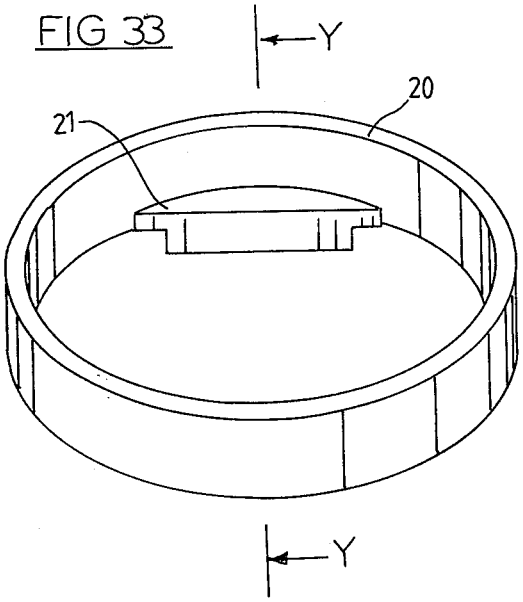
FIGS. 33 to 35 show a plain form ring having an angle form of retaining element.
Figure 35:
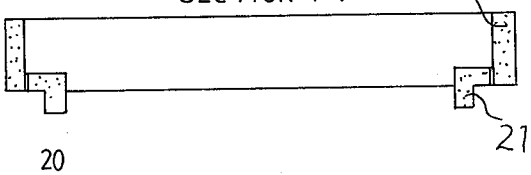
Figure 34:
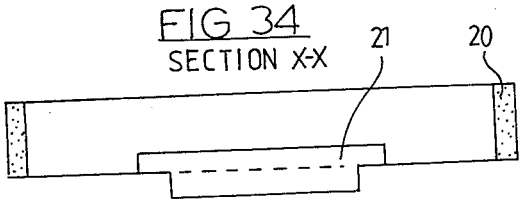

In FIGS. 33 to 35 the construction of FIG. 14 is shown in which an angle baffle is provided, again for the purpose of retaining filling without the use of further retention means.

Figure 36:
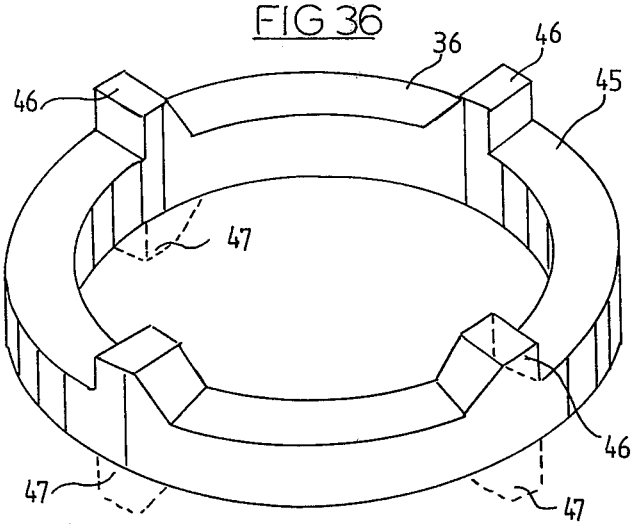
FIG. 36 shows a form of ring having extensions arranged to retain the rings in position relative to each other.

In FIG. 36 a ring 45 is provided having projections 46 on one side of the ring 45 and if desired further projections 47 may also be provided on the other side of the ring.

The above constructions all relate to precast rings and although the preferred precast material is concrete, other suitable precast materials may be used, for example, reinforced concrete, fired clay, asbestos cement and fibreglass reinforced cement or plastics. Cast metal may be used although here the cost would probably be prohibitive unless some form of channel shaped or other hollow section ring was provided. Rings made of cast material may be provided with internal reinforcing as described, such internal reinforcing is preferred in concrete ring members.

Figure 39:
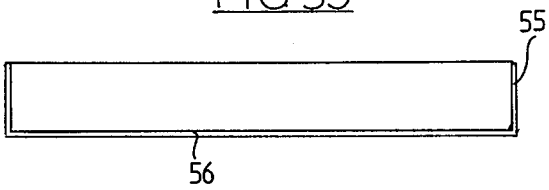
FIG. 39 is a cross section of the ring shown in FIG. 38.
Figure 38:
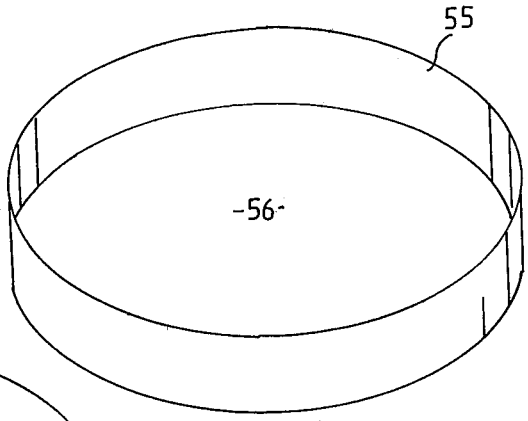
FIG. 38 is a perspective view of a metal ring having a disc form bottom.
Figure 37:
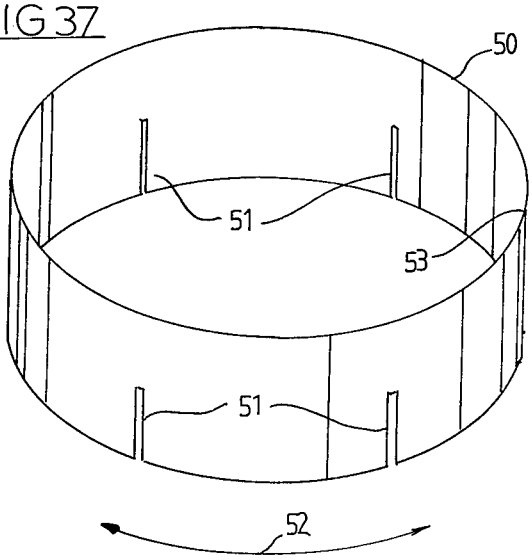
FIG. 37 is an isometric sketch of a form of ring particularly suited to metal construction.

However the invention also envisages the provision of a metal ring as shown in FIG. 37 in which the ring 50 is of substantially the form shown in FIG. 1 except that it is of sheet metal. Slots 51 are provided on radial lines having an arc of 60° as shown at 52. The metal member may be supplied to a site in flat form and then the two ends joined as shown at 53 by any suitable means, for example, a hook joint or by tabs or by any other suitable method. Again as is shown in FIG. 38 a metal ring 55 may be provided with a disc bottom 56, the construction of FIG. 38 being shown in section in FIG. 39.

Figure 24:
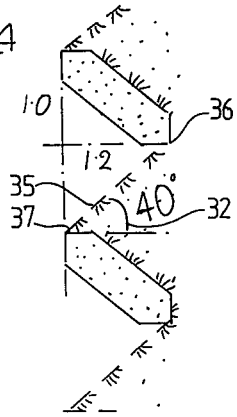
Figure 23:
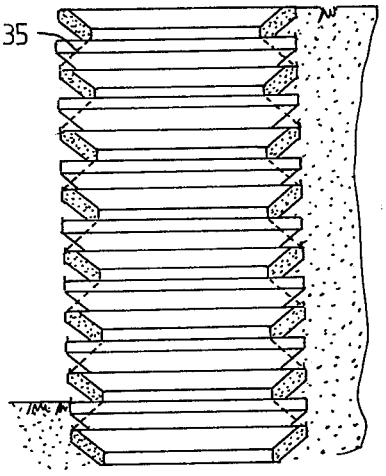
Figure 41:
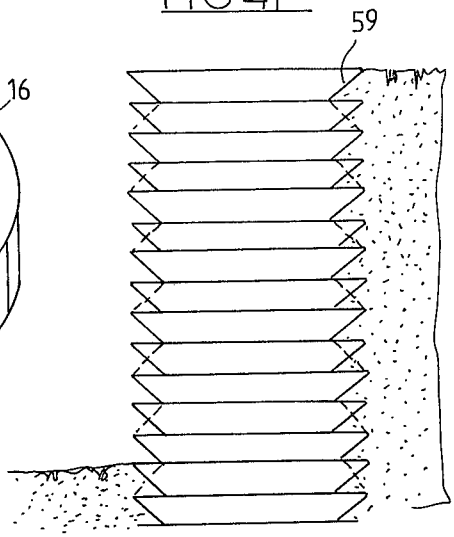
FIG. 41 is a cross section of a series of metal rings corresponding to the ring shown in FIGS. 21 to 23.
Figure 42:
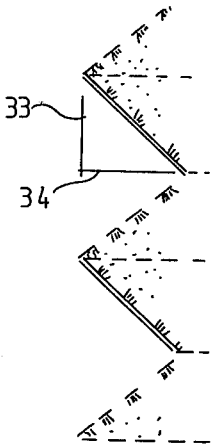
FIG. 42 is an enlargement of two rings shown in FIG. 41.
Figure 40:
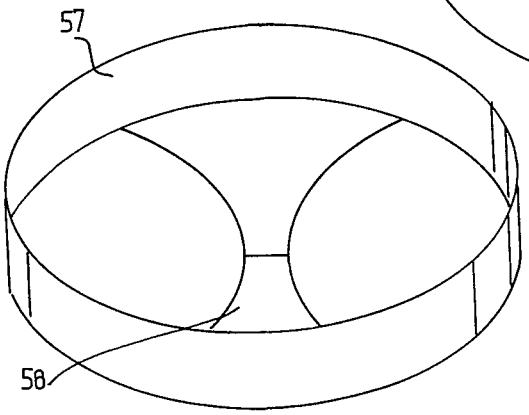
FIG. 40 is an isometric view of a metal ring having a cusp form bottom.

In FIG. 40 a metal ring 57 is provided with a cusp form 58 and in FIGS. 41 and 42 metal rings in the form of frusta of cones 59 are shown mounted in a column in a similar manner to the manner in which precast rings as shown in FIGS. 23 and 24. Again the dimensions 33 and 34 are provided to result in soil retention without the use of further retaining means.

Figure 44:
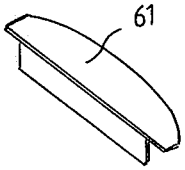
FIG. 44 is an isometric sketch of that angle baffle.
Figure 43:
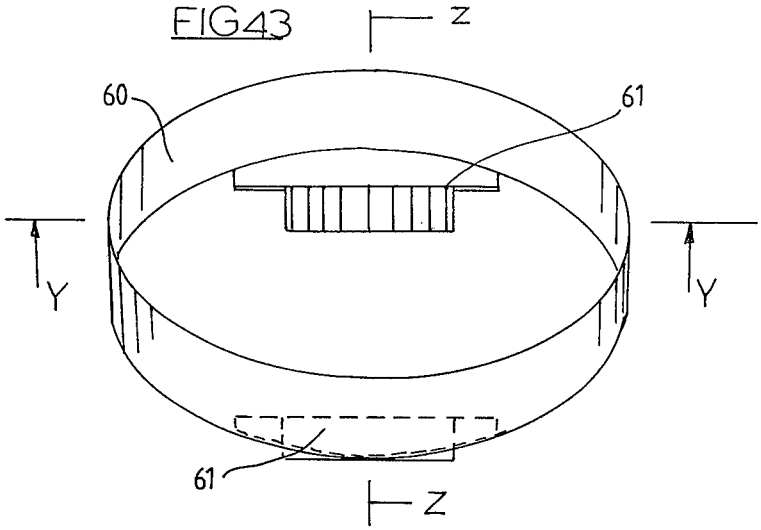
FIG. 43 is an isometric view of a metal ring including an angle baffle.
Figure 45:
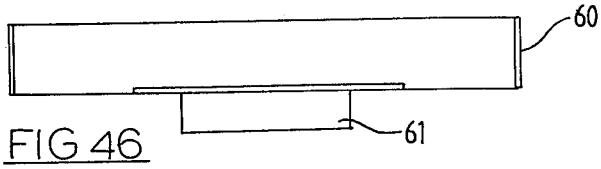
FIG. 45 is a cross section on the line Y—Y FIG. 43.
Figure 46:
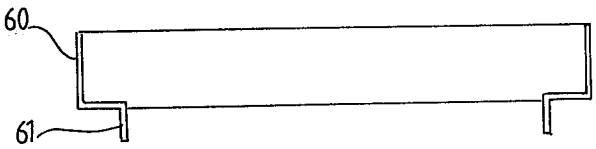
FIG. 46 is a cross section on the section Z—Z FIG. 43.

In FIGS. 43 to 46 a metal ring 60 is provided with angle baffles 61 such angle baffles being shown in more detail in the isometric sketch of FIG. 44 and the cross sectional sketches of FIGS. 45 and 46.

In FIG. 47 the interlinking of two rows of rings is shown a lower row consisting of rings 71, 72 and 73 and an upper row consisting of rings 74 and 75. Rings 71 and 72 touch at point 76 and rings 72 and 73 touch at point 77. Ring 71 contacts ring 74 at points 78 and 79 and ring 74 in turn contacts ring 72 at point 80 and 81. Ring 72 in turn contacts ring 75 at points 82 and 83, while 75 contacts ring 73 at points 84 and 85.

It is to be noted that there is an arc of 60° between contact points 80 and 82, contact points 81 and 83 and so on. Thus the slots 2 and 51 when positioned at these 60° results in rings which will retain the soil without further retaining means. If the angle is varied slightly from 60° curved walls may be made.

In FIG. 48 plain rings 5 of the type shown in FIG. 17 are erected in a wall.

Figure 49:
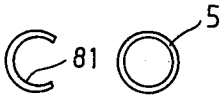
FIG. 49 is a plan view of full and part rings incorporated in the construction of FIG. 48.

In FIG. 49 the full rings 5 are shown together with part rings 81 the part rings 81 being used as shown in FIG. 48 as terminations to rows so that a more gradual slope of retained soil results than would be possible if only whole rings 5 were used.

If metal is used in the construction it is preferably used in a non corrosive form and such metals as copper, brass and stainless steel and galvanised or bitumen coated steel are envisaged.

If the purpose of the wall is to retain soil or other causeway, cutting or embankment filling behind the wall; then the wall itself is generally filled with crushed stone aggregate. In such a case the angle of repose of the fill material may be about 40° from the horizontal. If the width of the short tube (herein for convenience called a ring) with respect to the height of the ring is insufficient the filling material will spill out. Hence, for a vertical wall, constructed alternately of plain flat rings, the horizontal thickness T of the ring needs to be about 1.2 times the height H of the ring. If however the wall is canted back at say a batter of 1 in 4, the thickness T of the plain flat ring can be reduced to say 0.75 times the height H of the ring. If the open spaces between the plain flat rings described above can be fitted with castellated projections, up or down, on the front and rear of the individual rings, then the thickness T can be reduced to the thinnest practical value for the material being employed and the walls can be constructed with the front face vertical or battered as desired.

The cavities within and between the ring members can be filled with any suitable material such as crushed rock aggregate or concrete. If desired, steel reinforcing can be installed in the vertical or horizontal cavities inside the rings. Vertical reinforcing steel can readily be placed in the upright cavities in the rings before concrete is placed. Horizontal reinforcing steel can readily be accommodated by providing one or more grooves in the top or bottom edges of the rings or cylinders into which horizontal reinforcing steel can be laid before horizontal wall cavities are filled.

If desired, the cavities within and between the ring members may not be filled. For instance, a lake or marine sea wall constructed of suitably interlocked ring members may resist the action of waves better if not filled. It may be preferred to construct a ring wall without filling for other reasons, such as for use in a children's playground or an aesthetic feature in a garden, fountain or shopping plaza.

Whether rings and cylinders of concrete, metal or other suitable materials are used, retaining walls of the order of 6 meters high are possible at less expense to construct than previously. By using cross-ties to other retaining walls or ties to embedded anchors, walls higher than 6 meters can be constructed.

By using suitable tied flexible connections, the rings can be formed into multiple rows flexible chains or mats able to provide larger, wider or higher structures than for rows of single rings.

From the foregoing it will be seen that a wall for retaining soil is provided in a simple yet effective manner.

I claim:

1. A method of making a retaining wall using a series of rings in the form of short tubes formed to provide filling retaining means said method comprising the steps of stacking said rings in a single row along the length of the retaining wall, so that the wall has a thickness equal to the diameter of said rings, interlinking said rings one with the other during stacking so that a wall is constructed capable of resisting overturning forces applied normally to the height of the wall, arranging said rings during stacking so that adjacent rings in each row are closely adjacent to or touch each other and rings in adjacent rows are stretcher bonded so that the rings and the filling retaining means coact to retain loose filling placed within the erected rings at least when the surface of the filling exposed to view in the completed wall has attained its natural angle of repose.

2. A wall element comprising a ring in the form of a short tube constructed and arranged so that a series of such rings can be erected side by side and one above the other to provide a wall capable of resisting overturning forces applied normally to the height of the wall, each ring being formed to provide filling retaining means positioned and arranged so that in use loose filling above each ring is retained by the filling retaining means at least when the filling has attained its natural angle of repose, the construction and arrangement being such that in use on said ring being arranged in association with other such rings, adjacent rings in a row are closely adjacent to or touch each other and rings in adjacent rows are stretcher bonded so that the contact points on any selected ring are radial lines separated by an approximately 60° arc of the face of the ring exposed to view when looking at a retaining wall and of the unexposed face of the ring which is pressed against the soil retained by the retaining wall, and the rings and the retaining filling means thereof coact to retain loose filling placed within the erected rings at least when the surface of the filling exposed to view in the completed wall has attained in natural angle of repose.

3. The wall element as claimed in claim 2 wherein said filling retaining means comprise proportioning said ring so that the wall height is between 0.83 to 1.33 times the thickness of the wall of the ring.

4. The wall element as claimed in claim 2 wherein said filling retaining means are provided by slots in one edge of said ring arranged so that there is an overlap of height of adjacent rings in use.

5. The wall element as claimed in claim 2 wherein said filling retaining means comprises merlons appended to a lower edge of said ring.

6. The wall element as claimed in claim 2 wherein said filling retaining means comprises arranging the profile of said ring in the form of an inverted frustum of a cone.

7. The wall element as claimed in claim 2 wherein said filling retaining means comprises forming the cross section of said ring to an inverted L shape.

8. The wall element as claimed in claim 2 wherein said filling retaining means comprises a floor in said ring in the form of a cusp so that when a plurality of such rings are positioned in stretcher bond retention of filling results.

9. The wall element as claimed in claim 2 wherein said filling retaining means comprises a disc floor to said ring.

10. The wall element as claimed in claim 2 wherein said filling retaining means comprises an angled baffle positioned in use on the side of the ring nearest to a viewer looking at the exposed surface of a finished wall.

11. The wall element as claimed in claim 2 wherein said filling retaining means comprises a plurality of slots.

12. The wall element as claimed in claim 2 wherein said filling retaining means comprises a metal ring, said filling retaining means being provided by slots in one edge of said ring.

13. A wall comprising a plurality of rings in the form of short tubes formed to provide filling retaining means said rings being arranged side by side in rows and with successive rows one above the other bonded to each other to resist forces applied normally to the height of the wall, the rings being arranged so that adjacent rings in a row are closely adjacent to or touch each other and rings in adjacent rows are stretcher bonded so that the rings and the filling retaining means coact to retain loose filling placed within the erected rings at least when the surfaces of the filling exposed to view in the completed wall has attained its natural angle of repose.

* * * * *